US007828140B2

(12) United States Patent
Lee et al.

(10) Patent No.: US 7,828,140 B2
(45) Date of Patent: Nov. 9, 2010

(54) STRUCTURE OF CAP HAVING STORAGE SPACE

(76) Inventors: Jeong-Min Lee, 10-92, Sibum Apt., 50 Yeuido-Dong, Youngdungpo-Gu, Seoul 150-894 (KR); Seong-Jae Lee, A-1208 Misung Apt., 37 Yeuido-Dong, Youngdungpo-Gu, Seoul 150-887 (KR)

( * ) Notice: Subject to any disclaimer, the term of this patent is extended or adjusted under 35 U.S.C. 154(b) by 964 days.

(21) Appl. No.: 10/592,025

(22) PCT Filed: Feb. 16, 2005

(86) PCT No.: PCT/KR2005/000416

§ 371 (c)(1),
(2), (4) Date: Sep. 7, 2006

(87) PCT Pub. No.: WO2005/079169

PCT Pub. Date: Sep. 1, 2005

(65) Prior Publication Data

US 2007/0062826 A1 Mar. 22, 2007

(30) Foreign Application Priority Data

| | | |
|---|---|---|
| Feb. 19, 2004 | (KR) | 10-2004-0012049 |
| Feb. 19, 2004 | (KR) | 10-2004-0012050 |
| Feb. 19, 2004 | (KR) | 10-2004-0012051 |
| Feb. 19, 2004 | (KR) | 10-2004-0012052 |
| Feb. 19, 2004 | (KR) | 10-2004-0012053 |
| Feb. 20, 2004 | (KR) | 10-2004-0012430 |
| Mar. 8, 2004 | (KR) | 10-2004-0016674 |
| Mar. 8, 2004 | (KR) | 10-2004-0016675 |
| Mar. 8, 2004 | (KR) | 10-2004-0016676 |

(51) Int. Cl.

| | |
|---|---|
| ***B65D 25/08*** | (2006.01) |
| ***B65D 1/24*** | (2006.01) |
| ***B67D 1/00*** | (2006.01) |
| ***B67D 3/00*** | (2006.01) |
| ***B67D 7/06*** | (2006.01) |

(52) U.S. Cl. ..... 206/222; 206/219; 220/522; 222/83; 222/511; 222/536

(58) Field of Classification Search ..... 206/219, 206/221, 222, 568, 528, 532, 445; 215/2, 215/288, DIG. 8, 6; 220/520, 521, 502, 522; 222/80, 83, 532, 536, 525, 138, 145.1, 541.1, 222/145.5; 426/86

See application file for complete search history.

(56) References Cited

U.S. PATENT DOCUMENTS 2,631,521 A * 3/1953 Atkins, Jr. ..... 99/275

(Continued)

FOREIGN PATENT DOCUMENTS

KR 2001-0000522 1/2001

(Continued)

*Primary Examiner*—Ehud Gartenberg
*Assistant Examiner*—Dene Quest
(74) *Attorney, Agent, or Firm*—Westman, Champlin & Kelly, P.A.

(57) ABSTRACT

A cap with a storage space for containing a secondary material includes a storage portion having a storage space and provided with a seal plate formed on a lower end of the storage space, an outer cap foldably formed on the storage portion and coupled to a spouting portion, a spouting member inserted in the spouting portion, and an operational member for breaking the seal plate when the spouting member is in operation.

5 Claims, 14 Drawing Sheets

U.S. PATENT DOCUMENTS

| | | | | | |
|---|---|---|---|---|---|
| 2,824,010 | A | * | 2/1958 | Pedersen | 426/120 |
| 3,089,626 | A | * | 5/1963 | Kubiliunas | 222/484 |
| 3,187,918 | A | * | 6/1965 | Moore | 215/11.6 |
| 3,220,588 | A | * | 11/1965 | Lipari | 206/222 |
| 3,599,838 | A | * | 8/1971 | LaVange | 222/129 |
| 3,891,125 | A | * | 6/1975 | Morane et al. | 222/129 |
| 4,177,938 | A | * | 12/1979 | Brina | 222/80 |
| 4,264,007 | A | * | 4/1981 | Hunt | 206/219 |
| 4,450,985 | A | * | 5/1984 | Beard | 222/402.22 |
| 4,722,449 | A | * | 2/1988 | Dubach | 215/235 |
| 5,114,011 | A | * | 5/1992 | Robbins, III | 206/499 |
| 6,003,728 | A | * | 12/1999 | Elliott | 222/81 |
| 6,098,795 | A | * | 8/2000 | Mollstam et al. | 206/222 |
| 6,105,760 | A | * | 8/2000 | Mollstam et al. | 206/222 |
| 6,161,728 | A | * | 12/2000 | Dark | 222/83 |
| 6,471,101 | B1 | * | 10/2002 | Vardanyan | 222/541.2 |
| 7,562,782 | B2 | * | 7/2009 | Yorita | 215/228 |
| 2003/0102318 | A1 | * | 6/2003 | Lee | 220/705 |
| 2003/0178433 | A1 | * | 9/2003 | Adams | 220/703 |
| 2004/0089165 | A1 | * | 5/2004 | Seelhofer | 99/516 |
| 2004/0161504 | A1 | * | 8/2004 | Daniels et al. | 426/115 |
| 2005/0263414 | A1 | * | 12/2005 | Harilela et al. | 206/221 |

FOREIGN PATENT DOCUMENTS

| | | |
|---|---|---|
| KR | 2001-0016054 | 3/2001 |
| KR | 2001-0025219 | 4/2001 |
| KR | 2001-0078451 | 8/2001 |
| KR | 2001-0087800 | 9/2001 |
| KR | 2002-0023258 | 3/2002 |
| KR | 2002-0023978 | 3/2002 |

* cited by examiner

STRUCTURE OF CAP HAVING STORAGE SPACE

CROSS-REFERENCE TO RELATED APPLICATION

This Application is a Section 371 National Stage Application of International Application No. PCT/KR2005/000416, filed 16 Feb. 2005 and published as WO 2005/079169 on 1 Sep. 2005, in English, the application of which is based on and claims the benefit of Korean Patent Application No. 10-2004-0012050 filed on Feb. 19, 2004; Korean Patent Application No. 10-2004-0012051 filed on Feb. 19, 2004; Korean Patent Application No. 10-2004-0012053 filed on Feb. 19, 2004; Korean Patent Application No. 10-2004-0012052 filed on Feb. 19, 2004; Korean Patent Application No. 10-2004-0012049 filed on Feb. 19, 2004; Korean Patent Application No. 10-2004-0012430 filed on Feb. 20, 2004; Korean Patent Application No. 10-2004-0016674 filed on Mar. 8, 2004; Korean Patent Application No. 10-2004-0016676 filed on Mar. 8, 2004; Korean Patent Application No. 10-2004-0016675 filed on Mar. 8, 2004, the contents of which is hereby incorporated by reference in its entirety.

TECHNICAL FIELD

The present invention relates to a cap having a storage space storing different material that can be mixed with main material contained in a container.

BACKGROUND ART

In a variety of industrial field, it is sometimes necessary to mixed two or more different materials with each other to prepare a mixture, prior to using the mixture.

For example, when it comes to beverage industrial filed, users wishes to add a variety of flavors or vitamin to the water. To this end, the user purchases the flavor or vitamin and the separated bottle water and mixes the flavor or the vitamin with the bottle water.

SUMMARY OF THE INVENTION

Therefore, the present invention has been made in an effort to solve the above-described problems of the conventional art.

It is an object of the present invention to provide a cap with a storage chamber for a secondary material that will be mixed with a primary material contained in a container associated with the cap by simply opening the cap.

It is another object of the present invention to provide a product employing such a cap with a storage chamber for a secondary material.

To achieve the above objects, the present invention provides a cap with a storage space for containing a secondary material includes a storage portion having a storage space and provided with a seal plate formed on a lower end of the storage space, an outer cap foldably formed on the storage portion and coupled to a spouting portion, a spouting member inserted in the spouting portion, and an operational member for breaking the seal plate when the spouting member is in operation.

BEST MODE FOR CARRYING OUT THE INVENTION

Figure 1:
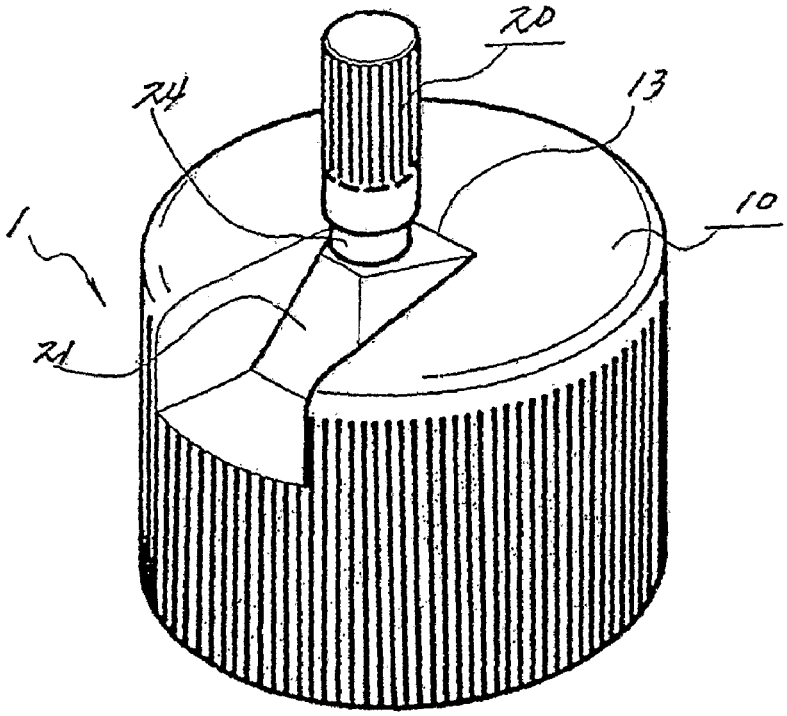
FIG. 1 is a perspective view of a cap with a storage space according to a first embodiment of the present invention.

Preferred embodiments of the present invention will be described more in detail hereinafter in conjunction with the accompanying drawings. Wherever possible, the same reference numerals will be used throughout the drawings to refer to the same or like parts.

Figure 2:
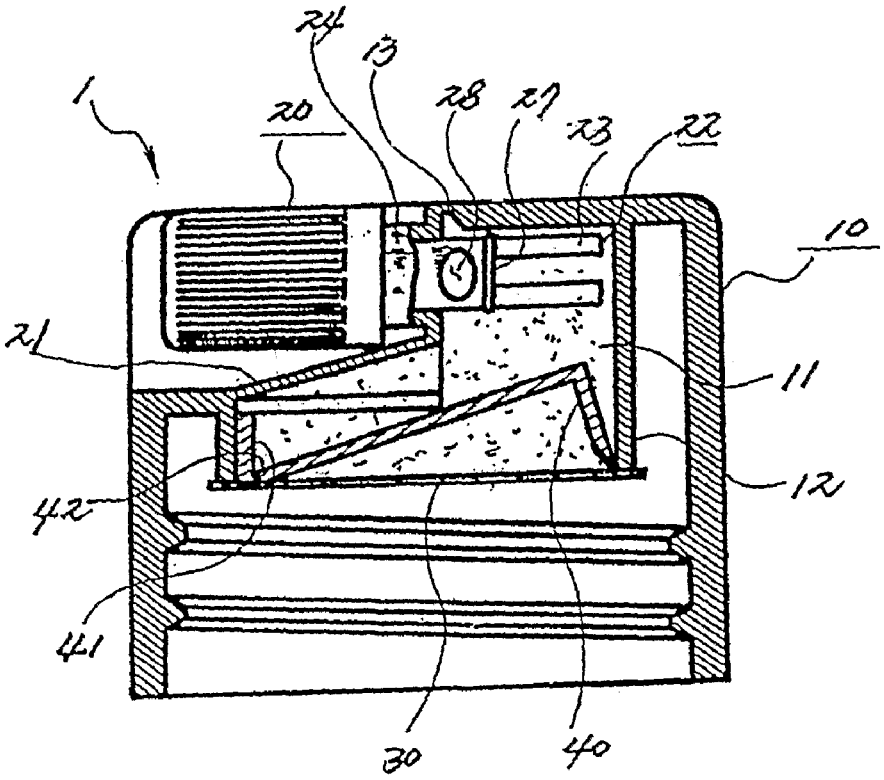
FIG. 2 is a sectional view of FIG. 1.
Figure 3:
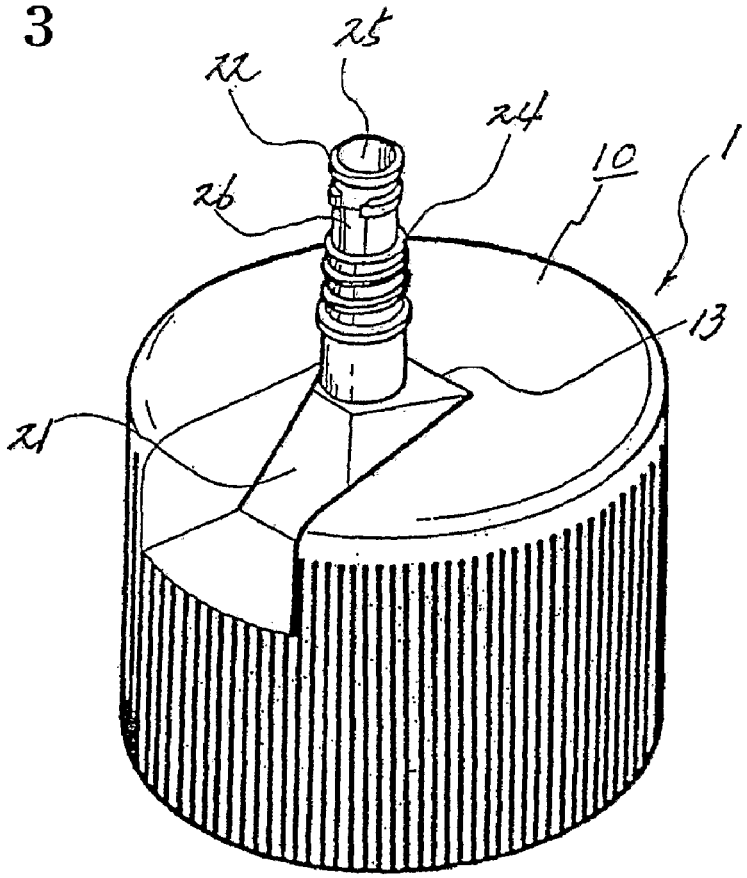
FIG. 3 is a perspective view illustrating a use of FIG. 1.

FIGS. 1 through 3 shows a cap according to a first embodiment of the present invention.

A cap 1 is screw-coupled to a container.

The cap 1 includes a cap main body 10 having a storage portion 12 defining a storage space 11 and an outer cap 20 coupled to the cap main body 10.

The cap 1 includes a seal plate 30 and an operation member 40 that is designed to break the seal plate according to the operation of the outer cap 20. The operational member 40 is located inside the storage portion 12.

The seal plate 30 is preferably formed of synthetic resin or aluminum, being attached on a lower end of the storage portion 12.

The cap main body 10 is provided with a folding portion 21 with a folding line 13. A spouting portion 24 is formed on an outer surface of the folding portion 21 and coupled to the outer cap 20. A spouting member 22 is inserted in the spouting portion 24.

The spouting member 22 is provided with an operational projection 23 extending downward to break the seal plate 30. A hook step 27 is formed on the spouting portion 24 to prevent the spouting member 22 from removing. A spouting hole 28 is provided to exhaust a mixture.

The spouting member 22 is provided with a spouting passage 25 and an air introduction portion 26 in a longitudinal direction.

The operational member 40 is provided with fixing portion 41 fixed inside the storage portion 12 and connected to the fixing portion 41 by a connection portion 42.

In the above-described embodiment, in a state when different material is stored in the storage portion 12, the seal plate 30 is attached and the cap main body 10 coupled to the outer cap 20 is fixed on the container.

In this state, the spouting portion 24 and the outer cap 20 are disposed on a horizontal plan as shown in FIG. 2.

At this point, as shown in FIG. 1, when the spouting portion 24 and the outer cap 20 are pivoted to a vertical position, the folding portion 21 is moved outward by the folding line 13 and the operational projection 23 formed on the spouting portion 22 pivots to allow the operational member 40 to pivot and break the seal plate 30.

Therefore, the different material stored in the storage portion 12 is dropt into the container to mix with main material contained in the container.

In this state, the outer cap 20 is separated and the mixture can be spouted through the spouting passage 25 through the spouting hole 28 of the spouting member 22.

Since the spouting member 22 is vertically movable, the user can be more easily drink the mixture. Furthermore, since the air introduction portion 26 is formed on the spouting member 22, the mixture can be effectively discharged.

Figure 4:
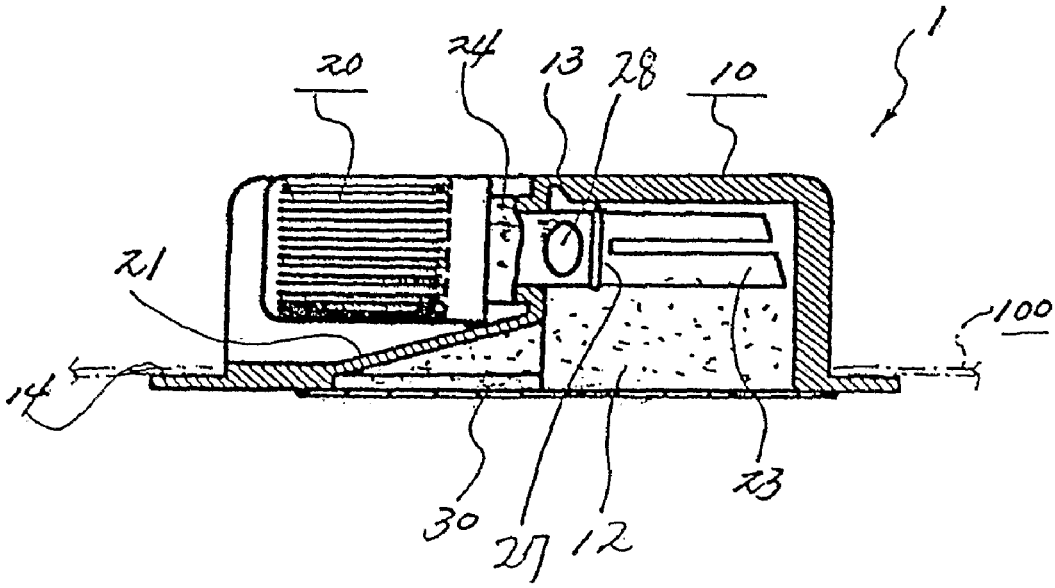
FIG. 4 is a sectional view of a cap according to a second embodiment of the present invention.

FIG. 4 shows a second embodiment of the present invention.

A cap main body 10 is provided with a storage space 11. A seal plate 30 is attached on a lower end of the storage space 11. A pouch container 100 is attached on the cap main body.

Figure 5:
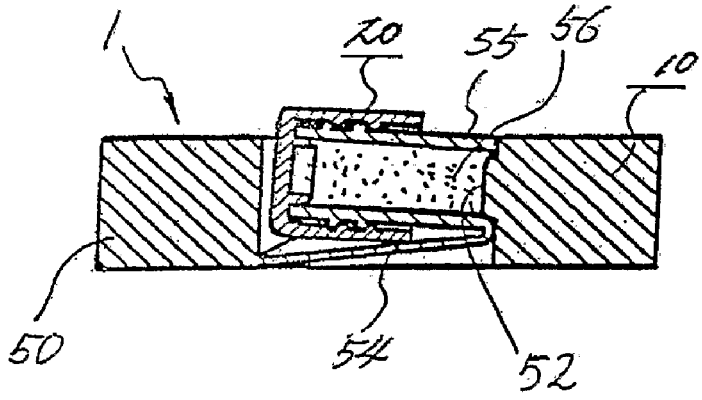
FIG. 5 is a sectional view of a cap according to a third embodiment of the present invention.
Figure 6:
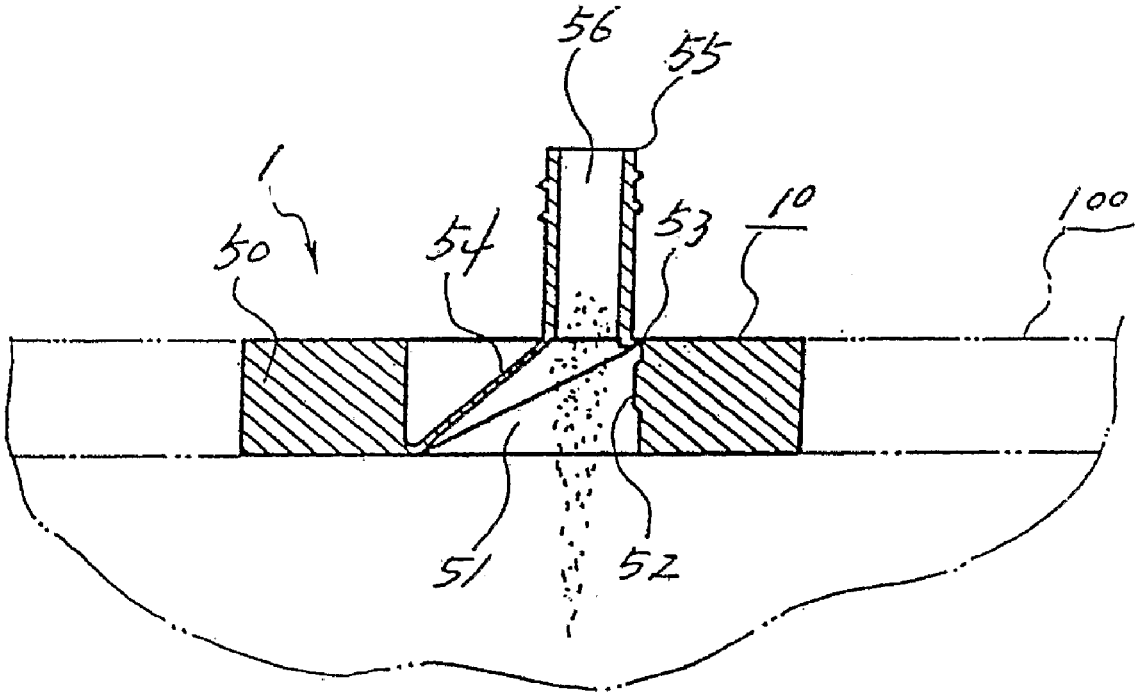
FIG. 6 is a view illustrating an operational state of a cap depicted in FIG. 5.

FIGS. 5 and 6 shows a third embodiment of the present invention.

In this embodiment, a seal step is formed in a space 51.

A folding portion is integrally formed in the space 51 with a folding line 53. A spouting portion 55 is formed in the folding portion and an outer cap 200 is coupled to the spouting portion 55.

Figure 7:
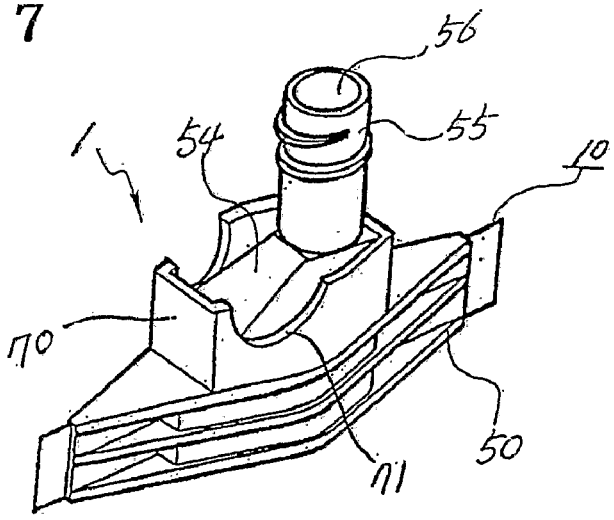
FIG. 7 is a perspective view of a modified example of a cap.

Referring to FIG. 7, a protecting member 70 is formed on an opened top of the cap main body 10, being provided with a concave portion 71.

Figure 9:
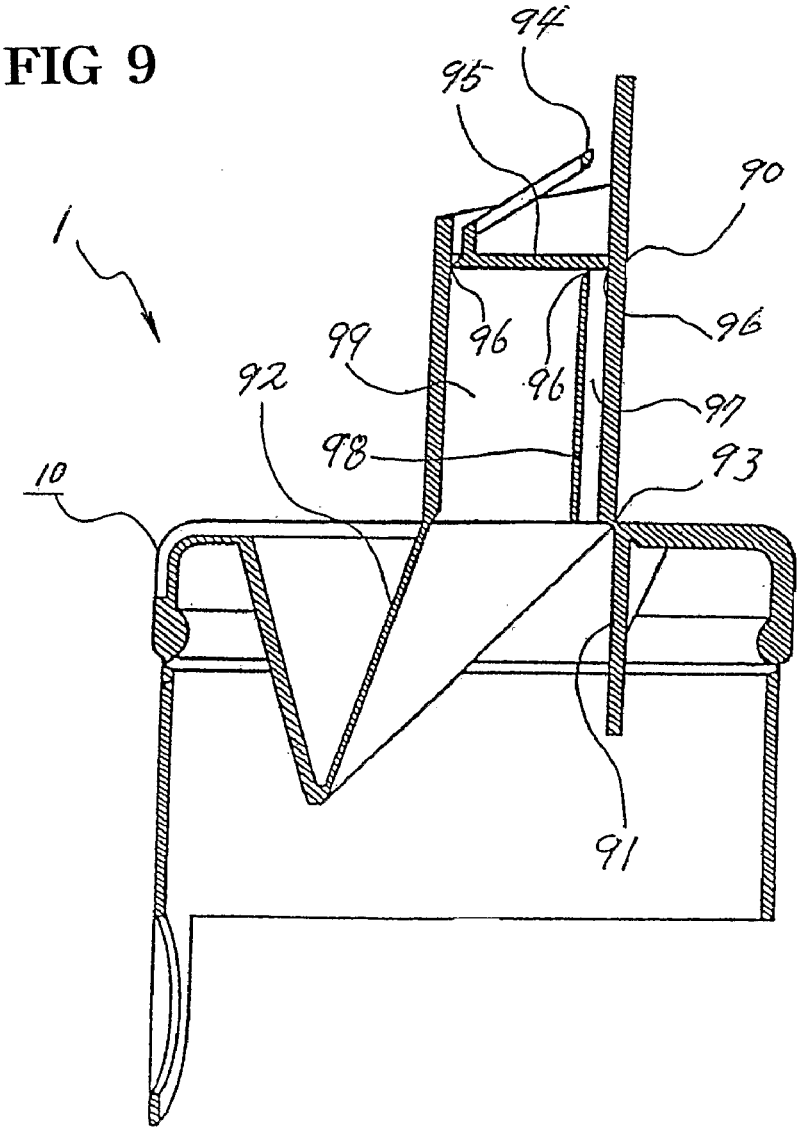
FIG. 8 through 10 are views of a cap according to a fourth embodiment of the present invention.
Figure 8:
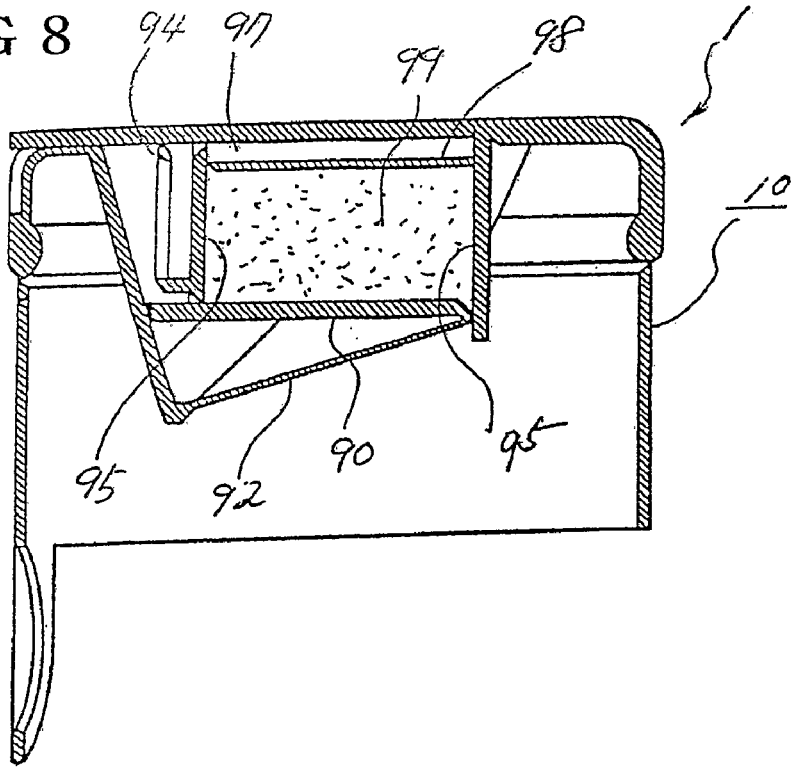
Figure 10:
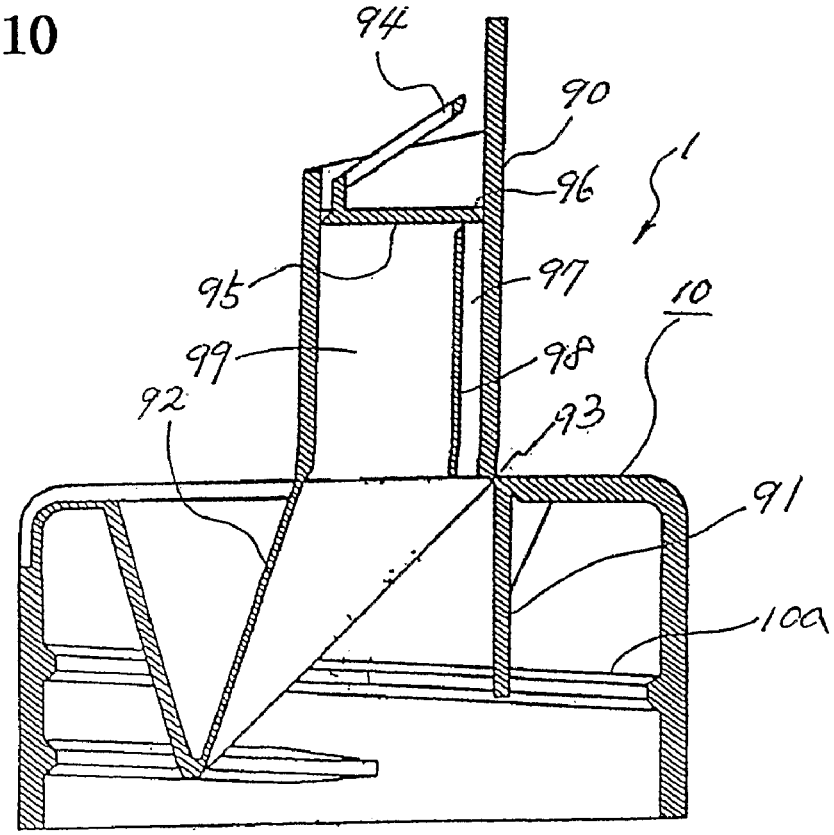

FIGS. 8 through 10 shows a fourth embodiment of the present invention.

A cap 1 includes a cap main body 10 and a spouting portion 90 formed on the cap main body.

A cutting plate 95 with a pulling ring 94 is formed on the spouting portion 92.

Figure 11:
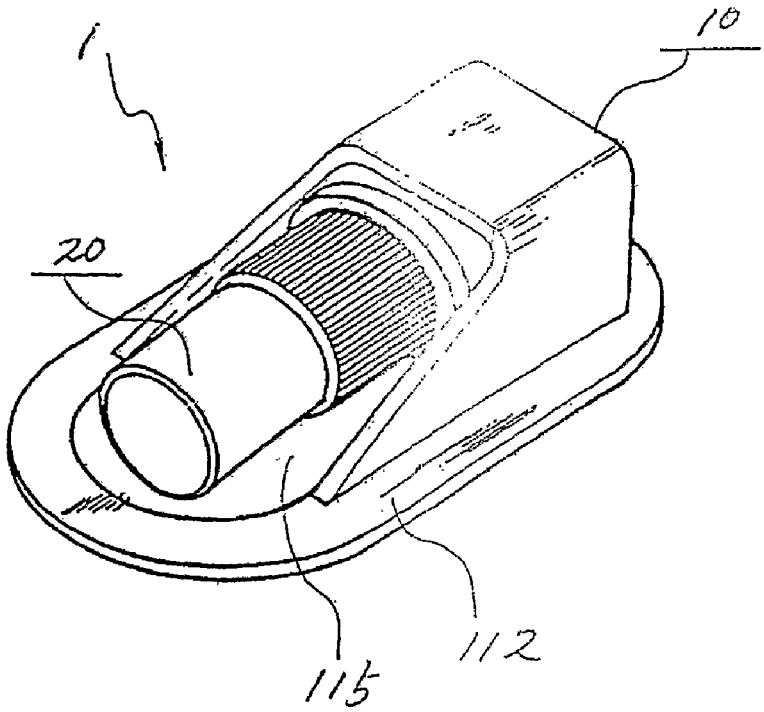
FIG. 11 through 13 are view of a cap according to a fifth embodiment of the present invention.
Figure 12:
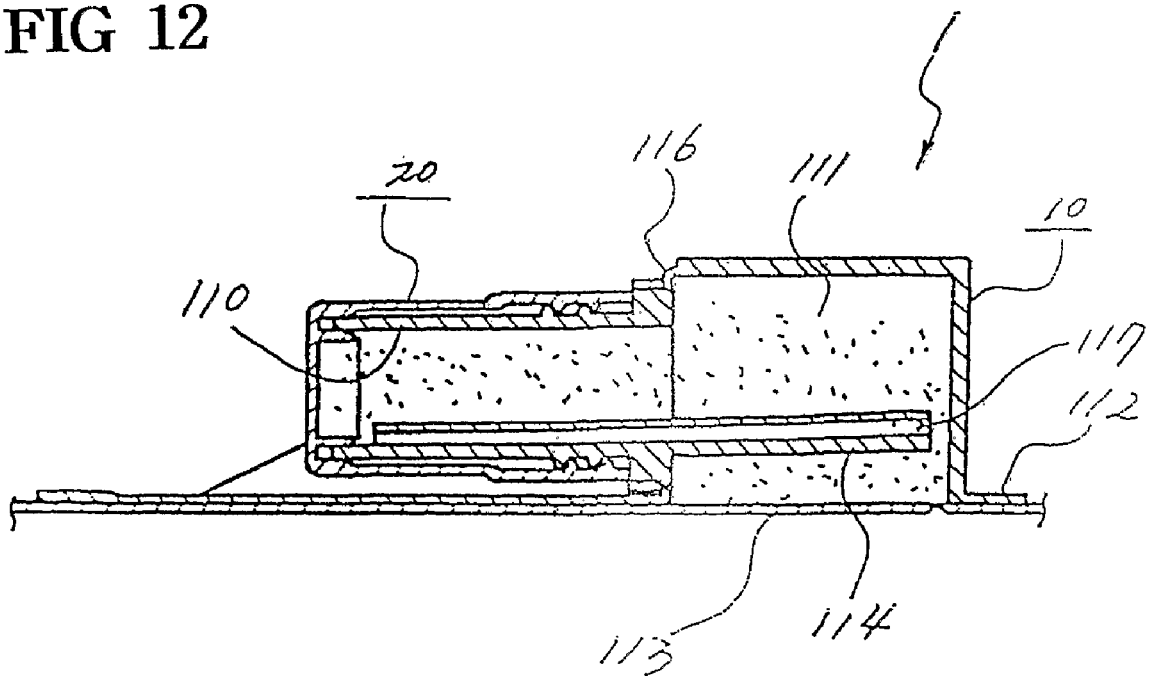
Figure 13:
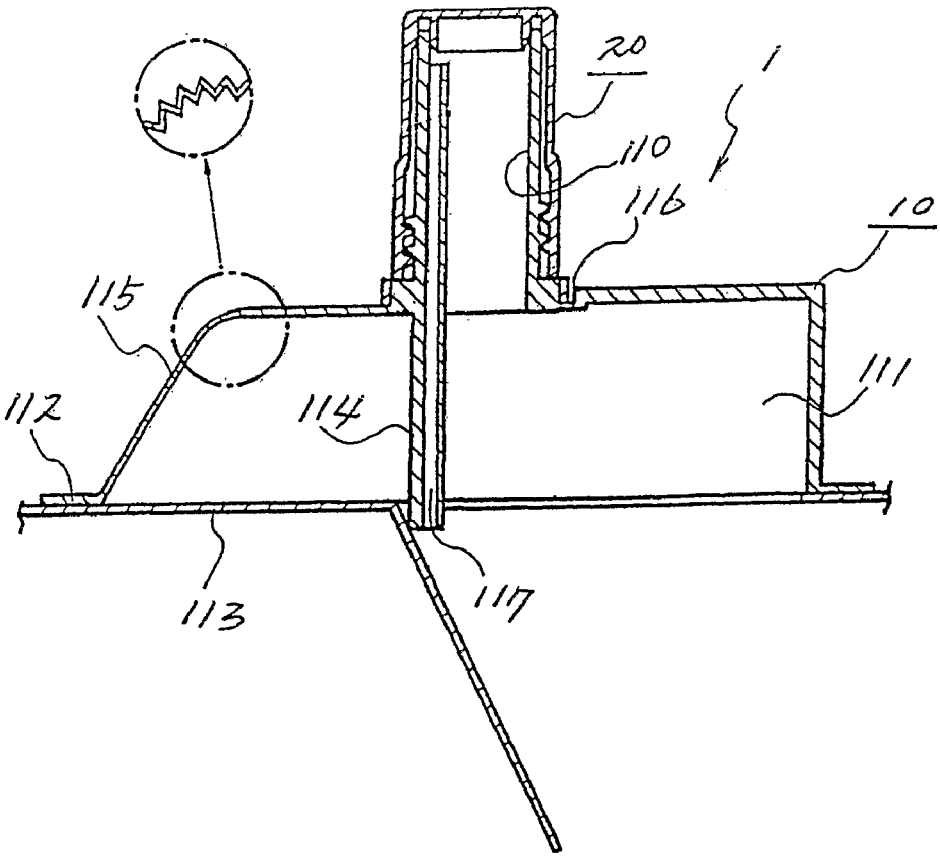

FIGS. 11 through 13 are views of a cap according to a fifth embodiment of the present invention.

This embodiment is similar to the first embodiment.

Figure 14:
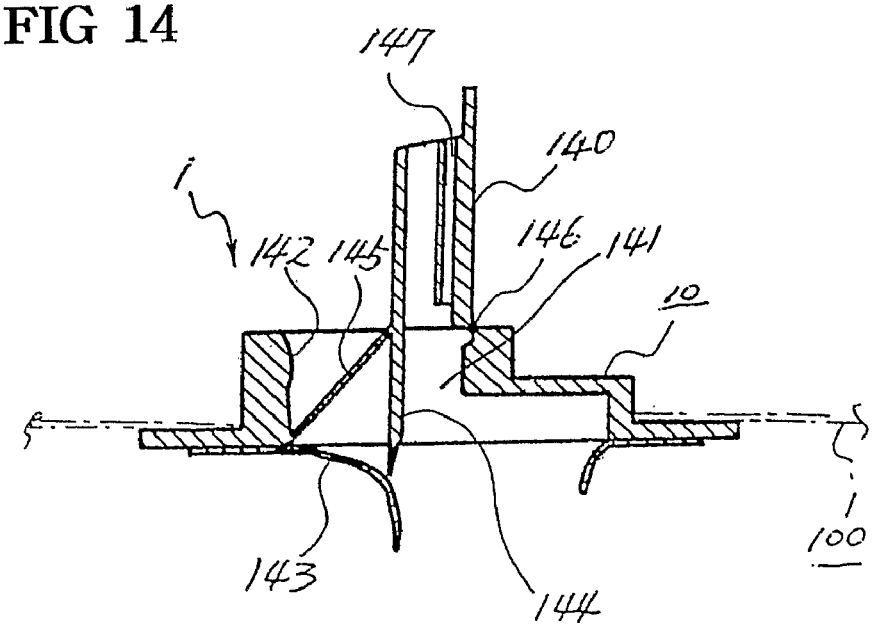
FIG. 14 is a sectional view of a cap according to a sixth embodiment of the present invention.

FIG. 14 is a sixth embodiment of the present invention.

A withdrawal wing 148 is formed on the spouting portion 140. In this embodiment, there is no need of an outer cap for opening the spouting portion 140.

Figure 15:
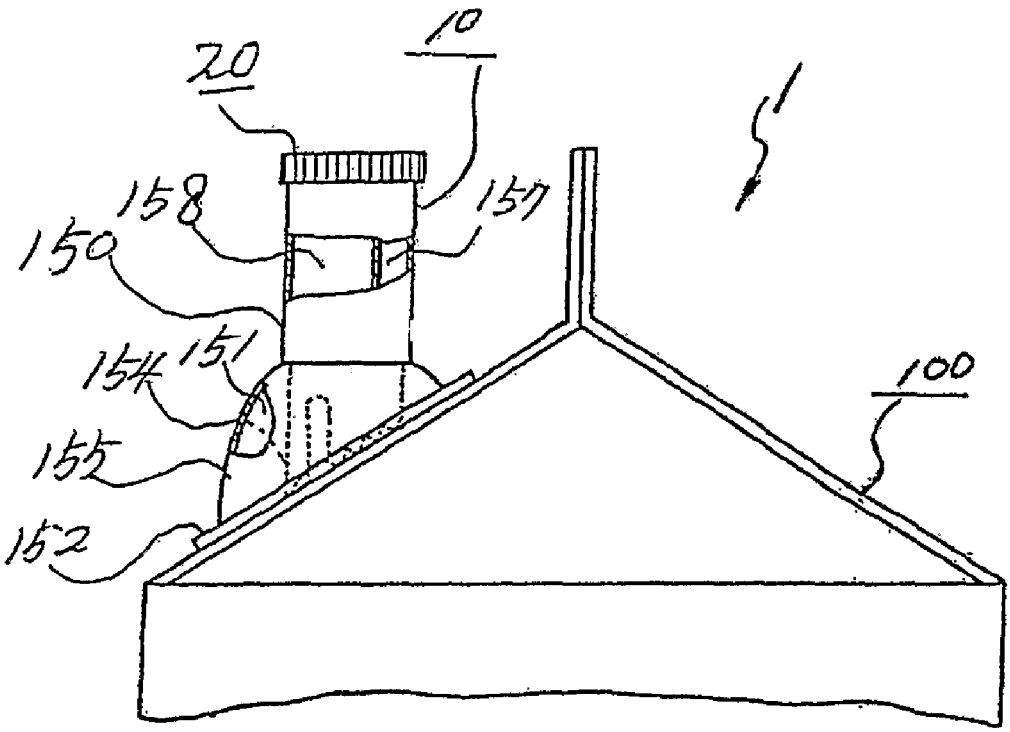
FIG. 15 is a partial broken side view of a cap structure of the present invention.
Figure 16:
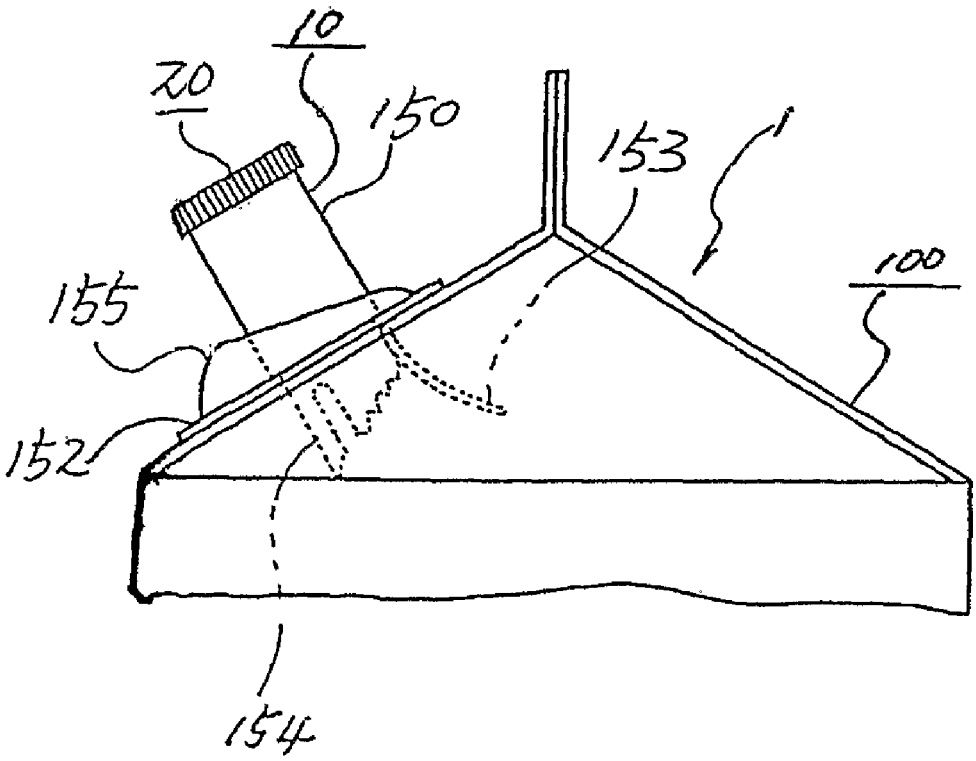
FIG. 16 is a view illustrating an operational state of a cap of the present invention.

FIGS. 15 through 16 shows a seventh embodiment of the present invention.

In this embodiment, the container is formed of a carton bag.

An air introduction portion 157 is formed on the spouting portion 150.

Figure 17:
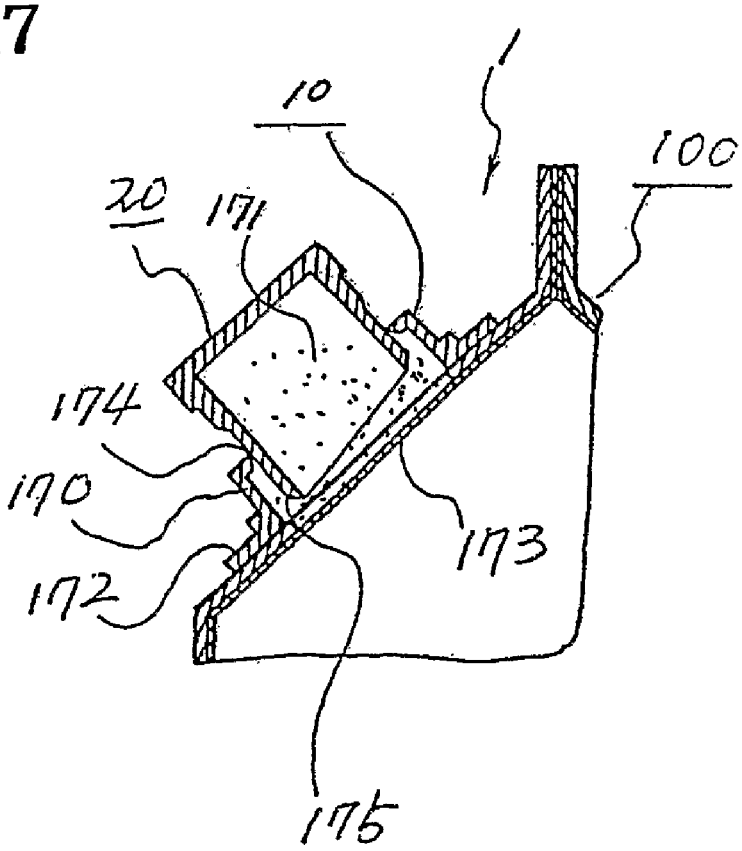
FIGS. 17 through 18 are views of a cap according to an eighth embodiment of the present invention.
Figure 18:
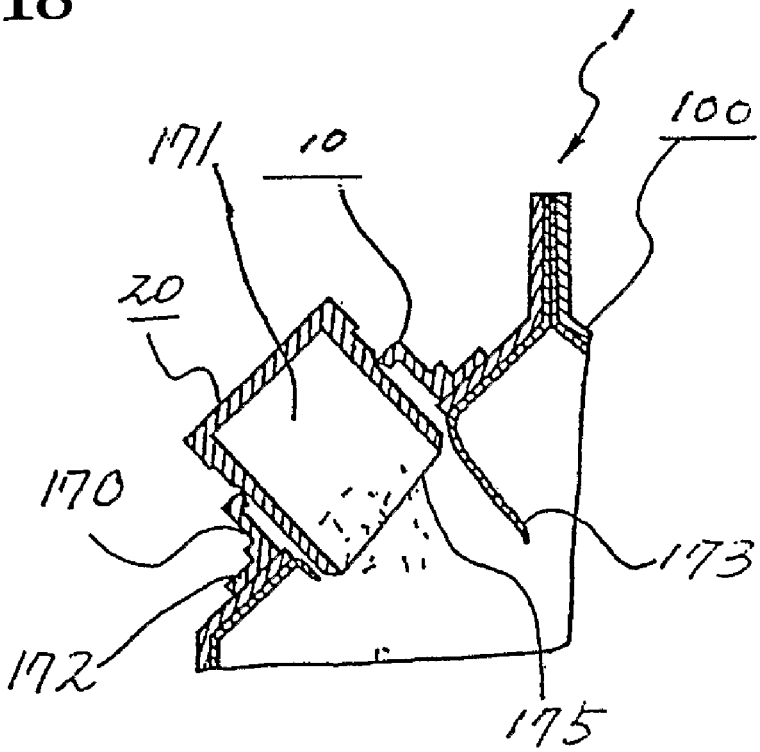

FIGS. 17 through 18 shows an eighth embodiment similar to the first embodiment.

Figure 19:
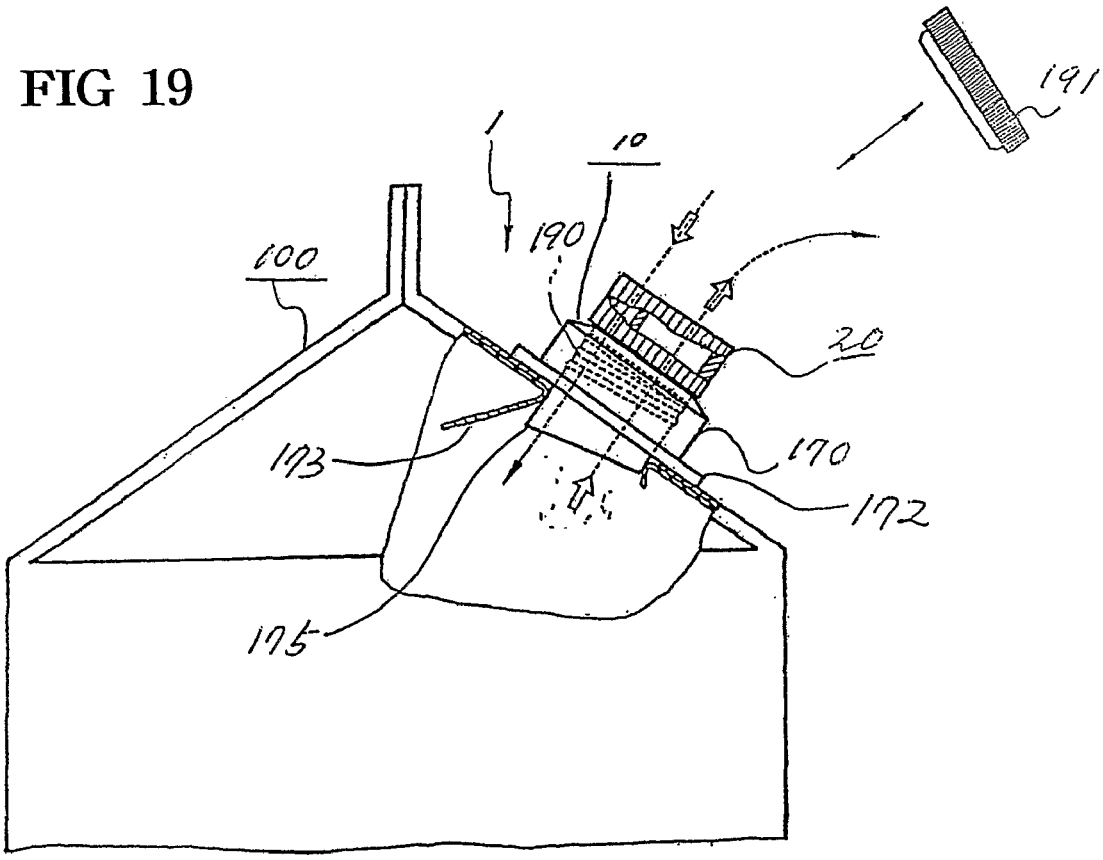
FIGS. 19 through 20 are views of a cap according to a ninth embodiment of the present invention.
Figure 20:
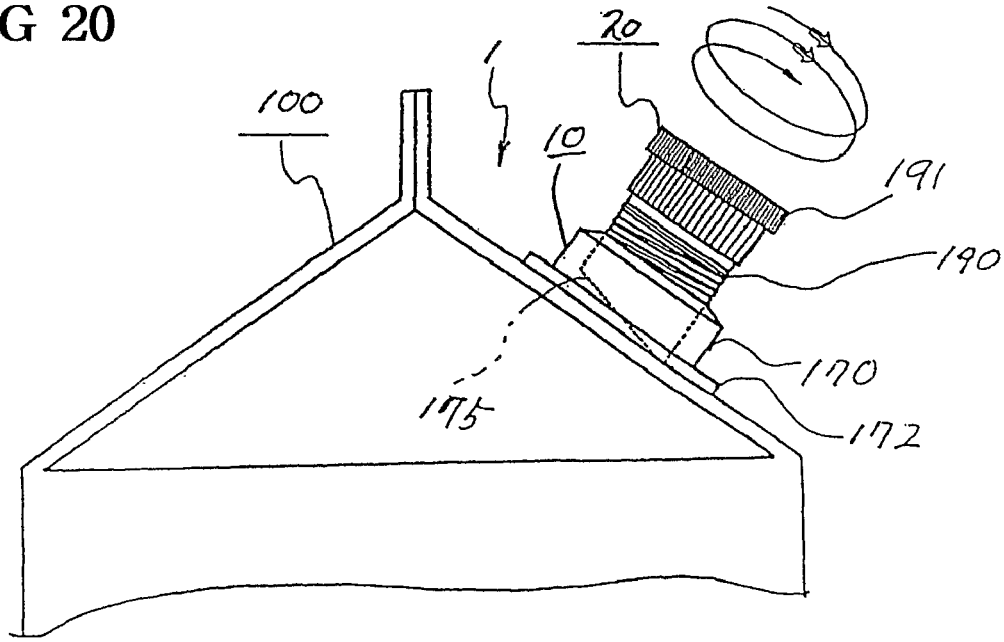

FIGS. 19 through 20 shows a ninth embodiment of the present invention similar to the eighth embodiment.

Figure 21:
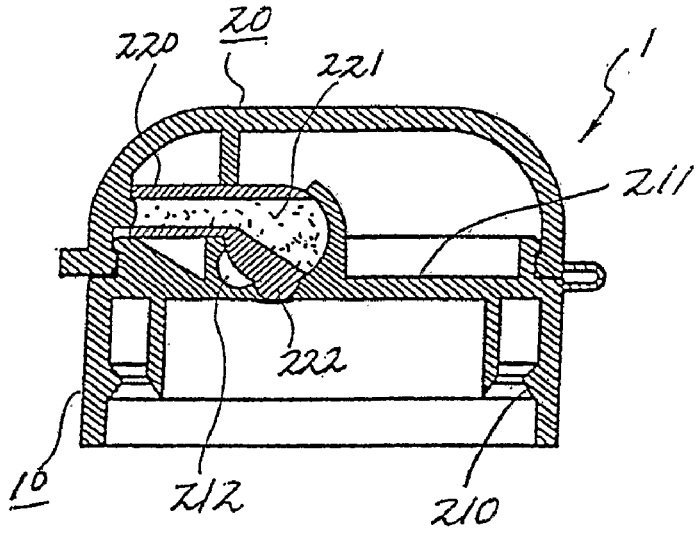
FIGS. 21 through 22 are views of a cap according to a tenth embodiment of the present invention.
Figure 22:
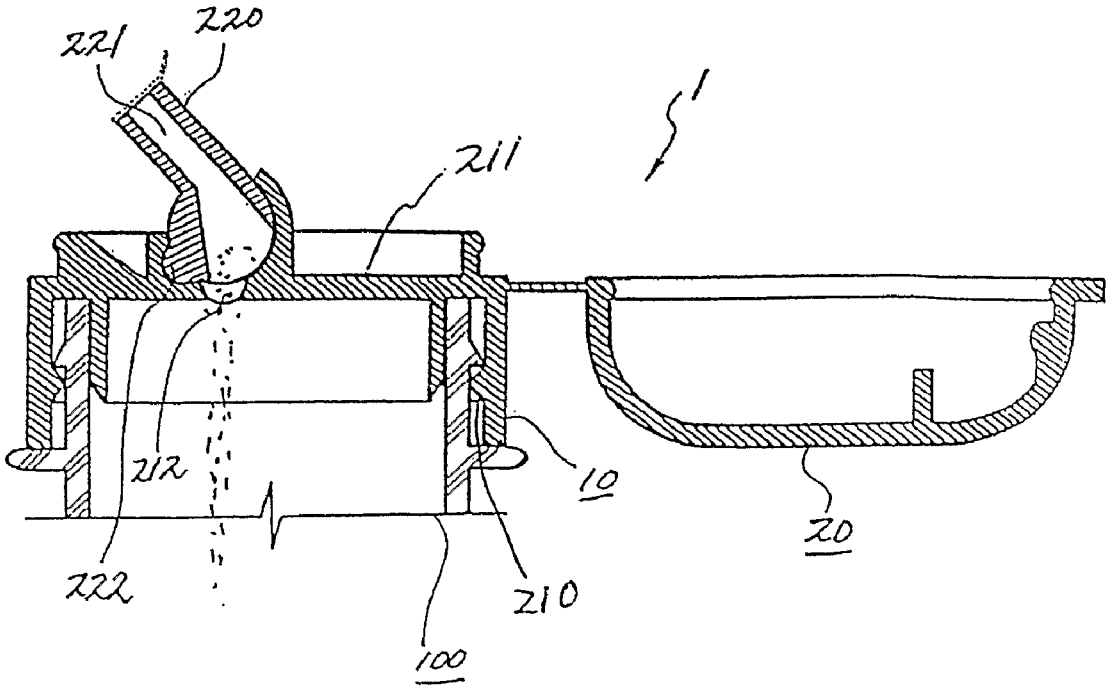

FIGS. 21 through 22 show a tenth embodiment of the present invention. A barrier 211 is formed on the cap main body.

A storage member 220 stores different material and is designed to be pivoted to exhaust the different material. After exhausting the different material, it functions as a spouting member for exhausting the mixture.

Figure 23:
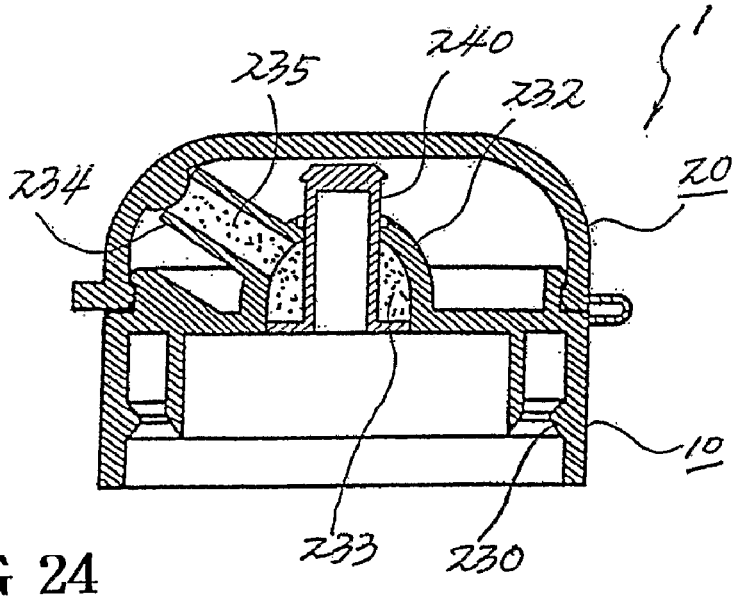
FIGS. 23 through 25 are views of a cap according to an eleventh embodiment of the present invention.
Figure 24:
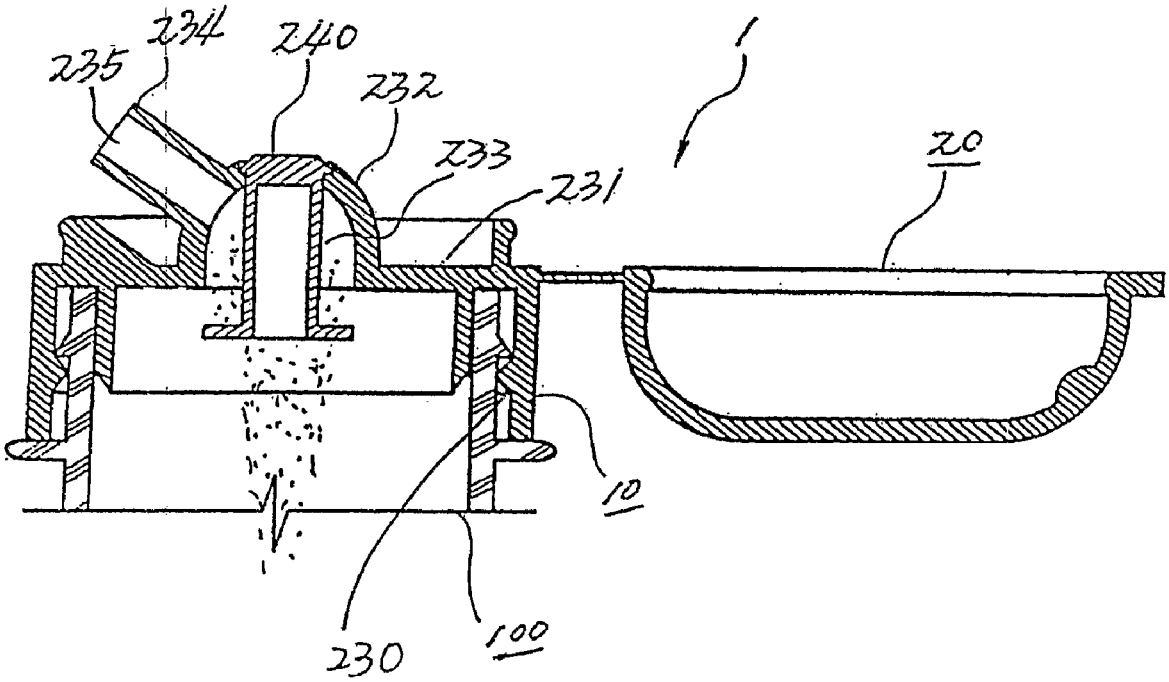
Figure 25:
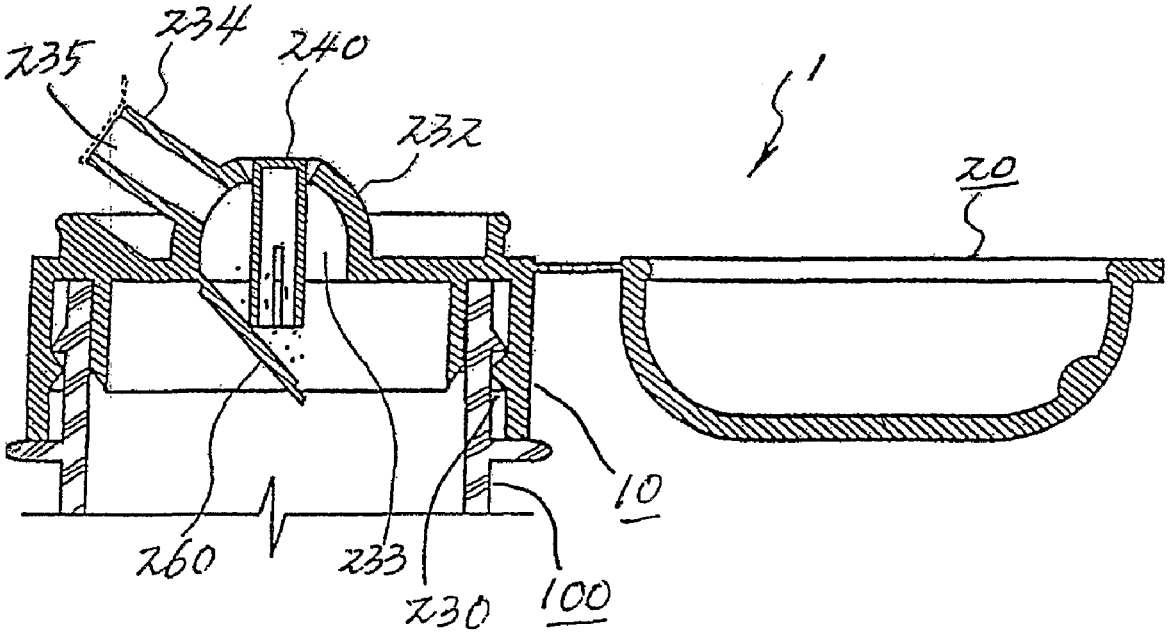

FIGS. 23 through 25 shows an eleventh embodiment of the present invention.

A spouting portion is formed on a storage portion 232. An operational member 240 is coupled to the storage space 233.

Figure 26:
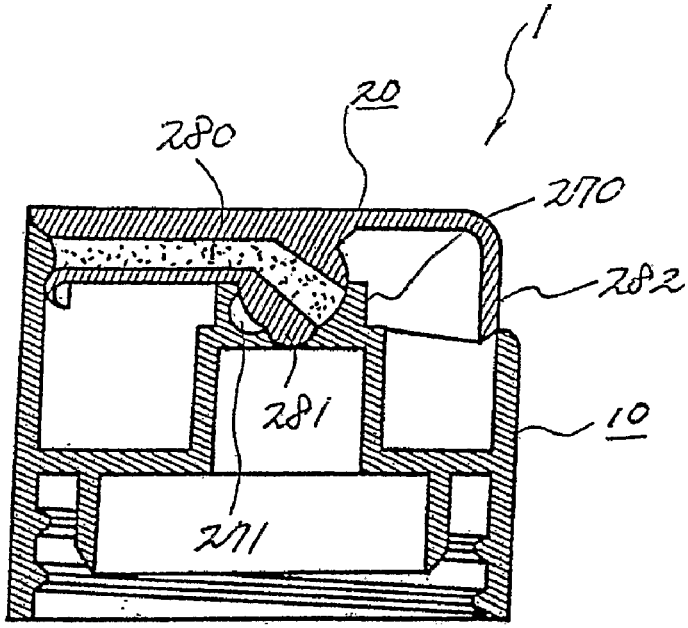
FIGS. 26 through 27 are views of a cap according to a twelfth embodiment of the present invention.
Figure 27:
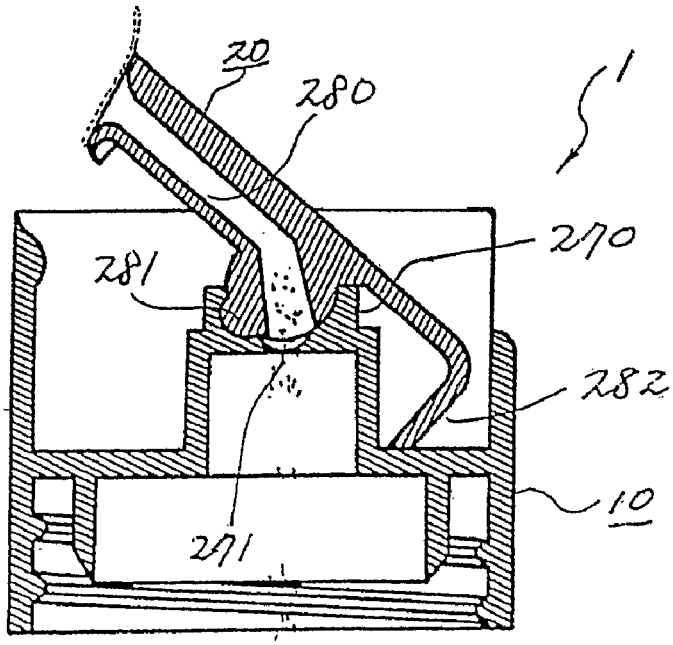

FIGS. 26 through 27 show a twelfth embodiment of the present invention.

An outer cap is pivotally coupled to a cap main body. The outer cap 20 is provided with a storage space 280. A stopper 282 is formed on the outer cap, which contacts a coupling portion.

The outer cap is rotated by a predetermined angle by the stopper 282 to communicate with a seal groove 271 of the storage space 280.

When the outer cap 20 is pivoted to a horizontal plate, the seal hole 271 is closed again.

INDUSTRIAL APPLICABILITY

As described above, the present invention is directed to a pouch container with a spout assembly, in which the spout assembly can be hygienically protected. The present invention is further directed to a method for mass production of such a pouch container.

The invention claimed is:

1. A cap with a storage space containing a material, comprising:

a storage portion having a storage space and provided with a seal plate formed on a lower end of the storage space;

an outer cap coupled to a spouting portion, the spouting portion is foldably formed on the storage portion, between a first position parallel with a top of the cap and a second position perpendicular with the top of the cap;

a spouting member inserted in the spouting portion and having an operational projection; and an operational member coupled to the storage portion and urged against the seal plate by the operational projection, thereby breaking the seal plate when the spouting portion is moved to the second position.

2. The cap of claim 1, wherein the spouting portion is formed on a folding portion with a folding line.

3. The cap of claim 1, wherein the operational projection applies a force to the operational member.

4. The cap of claim 1, wherein the spouting member is provided with an air introduction portion.

5. The cap of claim 1, wherein the operational member is affixed on an inner surface of the storage portion to move in a pivotal motion.

* * * * *